US007570777B1

(12) United States Patent
Taenzer et al.

(10) Patent No.: US 7,570,777 B1
(45) Date of Patent: Aug. 4, 2009

(54) EARSET ASSEMBLY

(75) Inventors: Jon C. Taenzer, Los Altos, CA (US); Thanh Q. Nguyen, Irving, TX (US); Donald R. Saleh, Ventura, CA (US)

(73) Assignee: Step Labs, Inc., San Jose, CA (US)

( * ) Notice: Subject to any disclaimer, the term of this patent is extended or adjusted under 35 U.S.C. 154(b) by 0 days.

(21) Appl. No.: 10/757,796

(22) Filed: Jan. 13, 2004

(51) Int. Cl.
*H04R 25/00* (2006.01)

(52) U.S. Cl. ..... 381/381; 381/380

(58) Field of Classification Search ..... 379/430; 381/322, 330, 329, 324–328, 361, 367, 370–372, 381/374, 375, 379, 380–382
See application file for complete search history.

(56) References Cited

U.S. PATENT DOCUMENTS

| | | | | | |
|---|---|---|---|---|---|
| 2,487,038 | A * | 11/1949 | Baum | 381/380 |
| 2,545,731 | A * | 3/1951 | French | 381/382 |
| 3,324,253 | A * | 6/1967 | Uemura et al. | 381/189 |
| 4,585,089 | A * | 4/1986 | Topholm | 381/328 |
| 5,412,736 | A * | 5/1995 | Keliiliki | 381/381 |
| 5,659,156 | A | 8/1997 | Mauney et al. | 181/130 |
| 5,761,298 | A * | 6/1998 | Davis et al. | 379/430 |
| 6,009,183 | A | 12/1999 | Taenzer et al. | 381/330 |
| 6,021,207 | A | 2/2000 | Puthuff et al. | 381/330 |
| 6,181,801 | B1 | 1/2001 | Puthuff et al. | 381/380 |
| 6,438,245 | B1 | 8/2002 | Taenzer et al. | 381/330 |
| D469,081 | S | 1/2003 | Perszyk et al. | D14/205 |
| 7,079,664 | B2 * | 7/2006 | Nassimi | 381/382 |
| 7,212,646 | B2 * | 5/2007 | Nassimi | 381/380 |
| 2002/0025055 | A1 * | 2/2002 | Stonikas et al. | 381/322 |
| 2002/0181728 | A1 * | 12/2002 | Connors et al. | 381/381 |
| 2003/0152244 | A1 * | 8/2003 | Dobras et al. | 381/381 |
| 2004/0037444 | A1 * | 2/2004 | Redmer et al. | 381/370 |
| 2004/0062412 | A1 * | 4/2004 | Nassimi | 381/380 |
| 2004/0101151 | A1 * | 5/2004 | Webber | 381/328 |
| 2005/0147269 | A1 * | 7/2005 | Oliveira et al. | 381/382 |

* cited by examiner

*Primary Examiner*—Suhan Ni
(74) *Attorney, Agent, or Firm*—Nixon Peabody LLP

(57) ABSTRACT

A wired or wireless earset assembly includes an earset housing having a curved portion configured to fit to the top of an ear, a speaker driver contained in a speaker housing, a flexible tube having a first extension so as to be coupled with at least a part of the curved portion of the earset housing and a second extension coupled with the speaker housing, a rotatable cap containing a bud coupled with the speaker driver, a sound delivery port in the bud, a circuitry for processing an input signal in the case, and a wire in the flexible tube connecting the circuitry and the speaker driver.

21 Claims, 13 Drawing Sheets

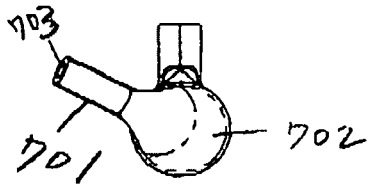
Fig 16
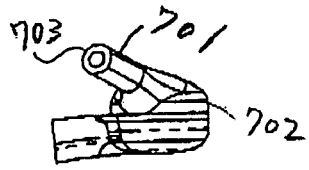
Fig 17
Fig 18
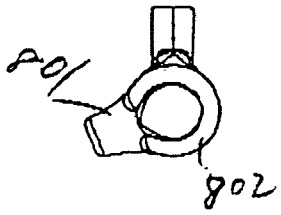
Fig 19
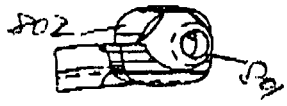

EARSET ASSEMBLY

FIELD OF THE INVENTION

The present invention relates to an earset assembly for a hearing aid, a mobile phone, a communication device for a personal computer, a multimedia device, etc. More particularly, the present invention relates to a wired or wireless non-occluding earset assembly.

BACKGROUND OF THE INVENTION

A sound delivery assembly for hearing aid, communication system or multimedia system is primarily configured to achieve high quality acoustic performance. It is also desired that the structure of the sound delivery assembly maintain in manufacture a designed user comfort in wearing it because he/she wants to use it for an extended time.

High quality acoustic performance is achieved by high efficiency and high fidelity of the sound delivery system. Efficiency of a sound delivery system is determined by the size of a speaker element and the distance to the entrance of the ear canal from the end of the sound delivery assembly. Fidelity of a sound delivery system is determined by a number of factors including the size of the speaker element and the length of a sound tube to deliver sounds.

So far, there are two primary types of sound delivery tools. One of them adopts an occluding earset structure such as an earmuff, an occluding earbud, or an occluding earmold. The other type adopts a non-occluding earset structure.

An ear-occluding structure such as the earmuff type achieves high quality acoustic performance because the size of a speaker element can be relatively large. Other ear-occluding structures such as the earbud and the earmold sound delivery systems also achieve high quality acoustic performance because the sound is delivered into the ear canal at the entrance of the ear canal and because the sound pressure is sealed in by the occlusion, thereby easily producing good bass and high sound level. Thus, small speaker drivers can be used with occluding systems. However, it is not physically comfortable for a user to occlude the ear for an extended period for two reasons: the physical discomfort due to pressure on the tissue required to get a good seal as the jaw and jaw muscles move and change the canal shape, and due to the disturbing and uncomfortable nature of the sound of the user's own voice (bassy and too loud) and audibility of bodily sounds (heart beat, blood flow, chewing sounds, clearing throat, etc.). Another reason for the user's discomfort is that a user has difficulty in hearing sounds other than that delivered by the sound delivery assembly. Lack of hearing the background sounds makes a user feel isolated from his surroundings and uncomfortable. Particularly, when a user uses a mobile phone or communicates with a computer or multimedia, he/she needs to hear the surrounding sounds for safety or as a necessary part of the experience.

Where the ear is not occluded, a user can hear surrounding sounds in addition to delivered sounds. Conventional non-occluding earsets are coupled with a relatively long sound tube for delivering sounds. They do not achieve high quality acoustic performance because their efficiency and fidelity are not high. Various structure of non-occluding earsets have been designed, however, they are not adjustable for each individual ear anatomy so that some users feel uncomfortable tension to the ear in wearing the earset or the earset provides compromised performance for some users due to the ill fit of the device.

U.S. Pat. No. 6,009,183 by Taenzer presents an ambidextrous sound delivery system. This sound delivery system uses a tube for delivering sounds. It has an ambidextrous feature provided by rotating the tube at its axis. However, the long tube affects the sound fidelity so that substantial additional form elements need to be included. Additionally, the tube terminates in the ear canal so that the accommodation of different ear sizes has to be done by flexing the tube creating uncomfortable pressure on the canal wall. Further, since the entrance to the ear canal has hair, some users report that an unbearably uncomfortable tickling sensation is produced by the tube.

U.S. Pat. No. 6,438,245 "Hearing Aid Communications Earpiece" shows an above-the-ear microphone for pickup of the user's own voice. U.S. Pat. Nos. 6,021,207 "Wireless Open Ear Canal Earpiece" and 6,181,801 "Wired Open Ear Canal Earpiece" show devices providing sound delivery to the ear canal in a non-occluding manner.

U.S. Pat. No. 5,659,156 by Mauney presents an earmold for two-way communications devices. This earmold is a non-occluding one designed to securely hold the earmold in the ear and deliver sounds at the entrance of the ear canal. However, this earmold has to be configured to fit each individual and must also be configured to separately fit right and left ears. It is not adjustable for the anatomy of each individual or ear.

An object of the present invention is to provide a earset assembly having a structure that easily fits to almost all people's either right or left ear and allows a user to wear it with great comfort on the ear for an extended period.

Another object of the present invention its to provide an earset subassembly which creates and assures good sound performance for almost all ears.

Another object of the present invention its to provide an earset subassembly which facilitates ease and flexibility in manufacturability of the assembly.

Another object of the present invention its to provide an earset subassembly which facilitates ease of testing of the assembly during manufacture.

SUMMARY OF THE INVENTION

An object of the present invention is to provide great comfort in the use of an earset assembly. A wired or wireless earset assembly comprises an earset housing having a curved portion configured to fit to a root of a top of an ear; a speaker driver having an input port, a speaker housing containing the speaker driver, a flexible neck tube having a first extension at a first end of the flexible neck so as to be coupled with at least a part of the curved portion of the earset housing and a second extension at a second end of the flexible tube coupled with the speaker housing, a rotatable cap containing a bud coupled with the speaker housing, circuitry for processing an input signal contained in the earset housing, having an input port and an output port, and a wire connecting the output port of the circuitry and an input port of the speaker driver. The wire is contained in the flexible neck tube. Because the structure of the non-occluding sound delivery assembly of the present invention does not give uncomfortable tension or pressure to the ear, a user can wear the sound delivery assembly with great comfort and high quality acoustic performance for an extended period. In addition, the present invention allows the sound delivery assembly to easily fit to almost all the person's either of right and left ears by an easy procedure. Furthermore, the present invention increases ease of manufacturability because the number of components in the assembly decreases.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings:

FIG. 16 is a front view of another embodiment of a rotatable cap 104 of FIG. 1.

FIG. 17 is a side view of another example of rotatable cap 104 of FIG. 1.

FIG. 18 is a front view of another example of rotatable cap 104 of FIG. 1.

FIG. 19 is a side view of another example of rotatable cap 104 of FIG. 1.

DETAILED DESCRIPTION

Figure 1:
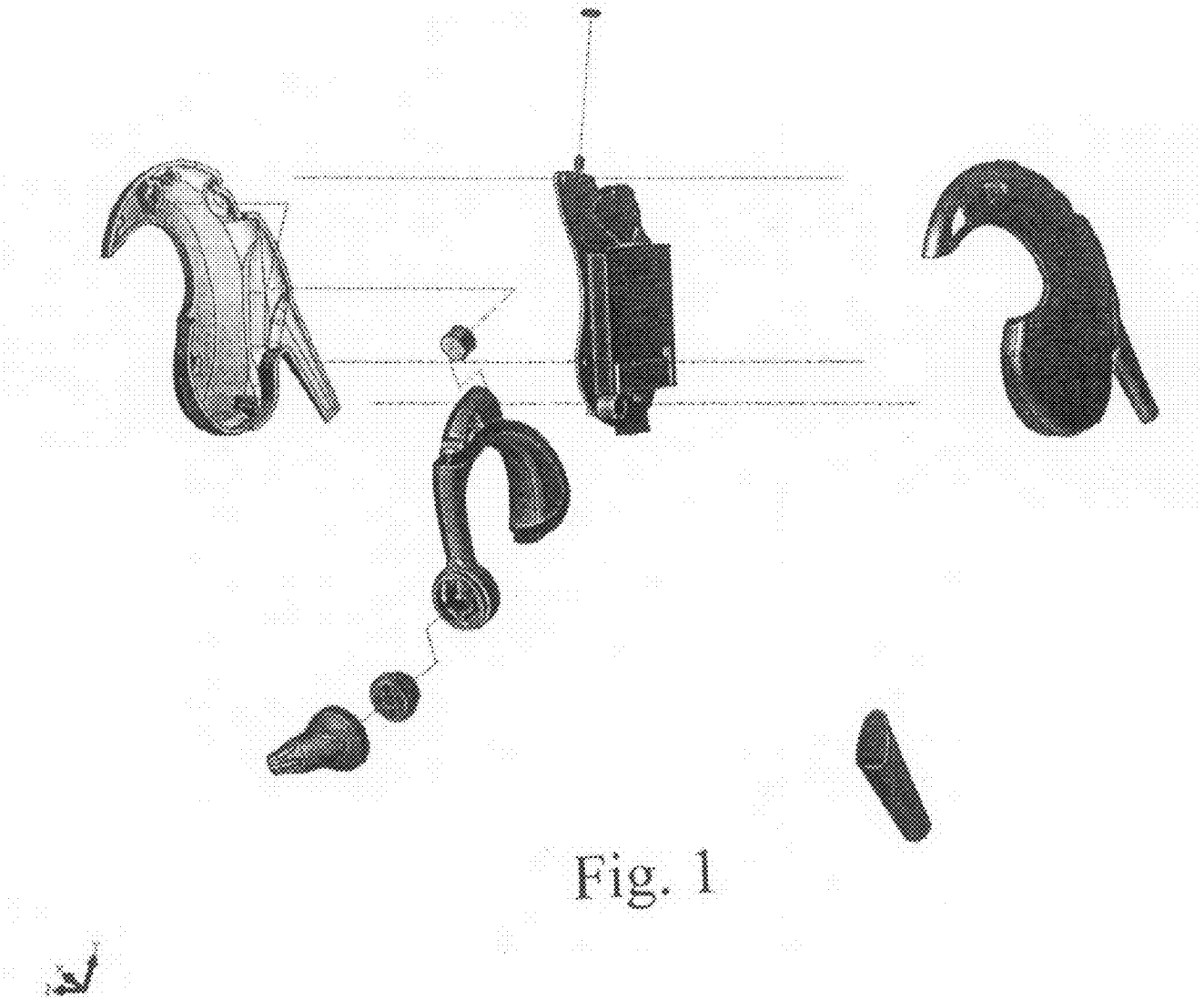
FIG. 1 is side view of an earset assembly in one embodiment of the present invention.
Figure 2:
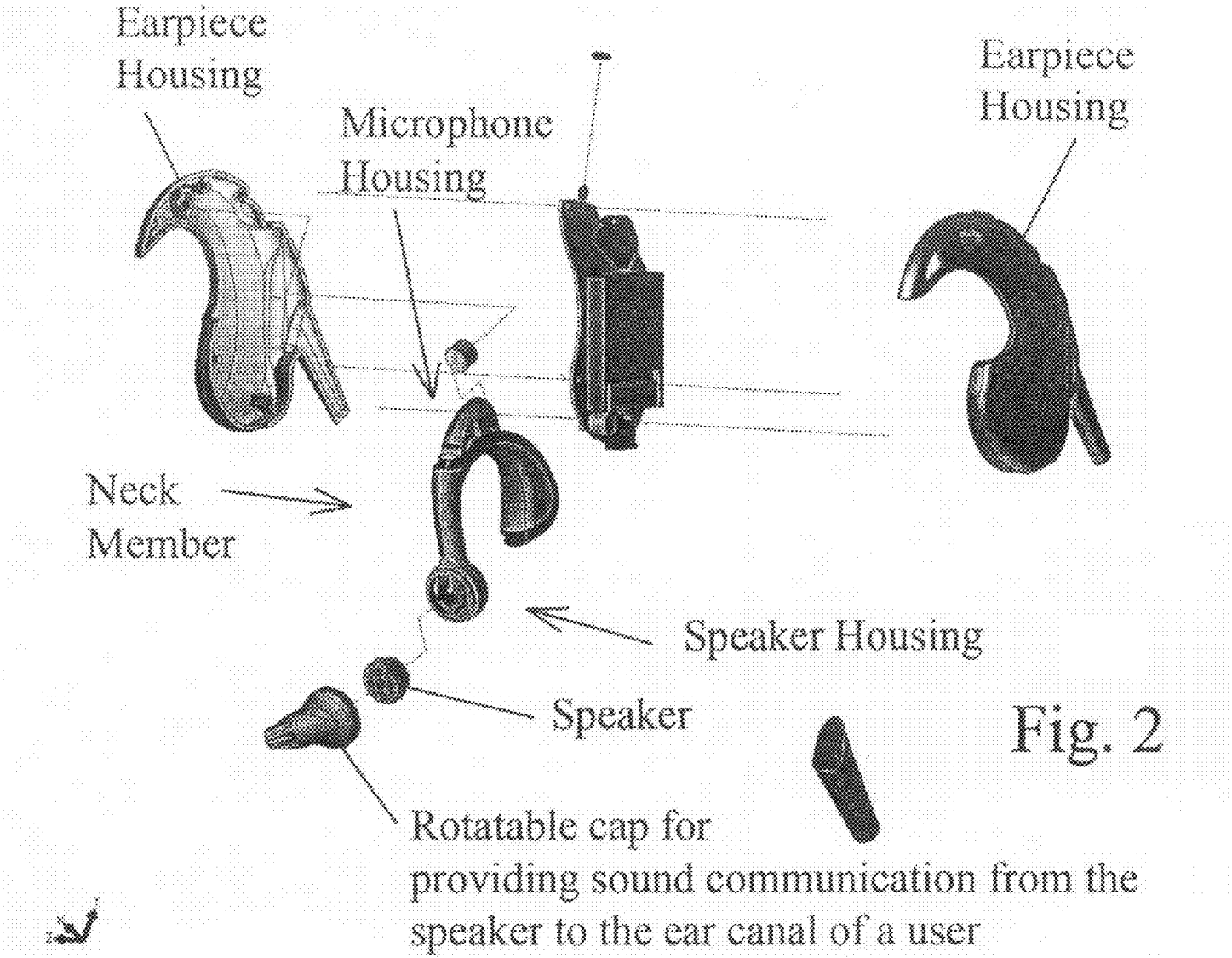
FIG. 2 is an end view of the device of FIG. 1.
Figure 4:
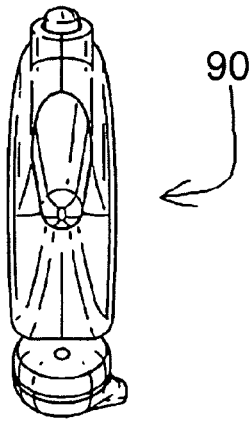
FIG. 4 is an end view of the device of FIG. 1.
Figure 3:
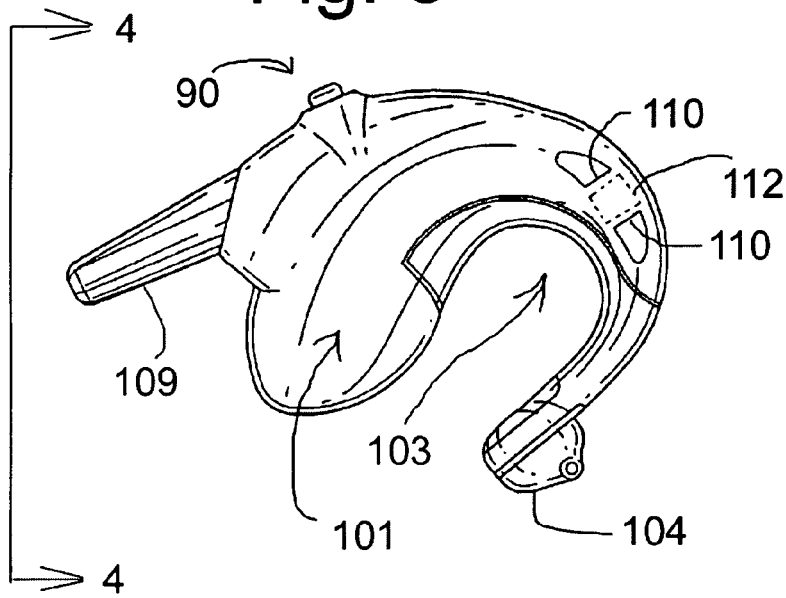
FIG. 3 is a view of the opposite side of the device of FIG. 1.

Embodiments of the present invention are described herein in the context of an earset assembly. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

As shown in FIGS. 1-4, the earset assembly 90 comprises earset housing 101, neck member 103, rotatable cap 104 having bud 105, and speaker housing 107 for housing a speaker. Earset assembly 90 includes curved portion 102 configured to fit to the top of a user's ear and antenna enclosure portion 109. Earset housing 101 includes four holes 110 so that a microphone 112 placed near holes 110 can receive sounds. Optionally, antenna enclosure portion 109 may be omitted.

Figure 5:
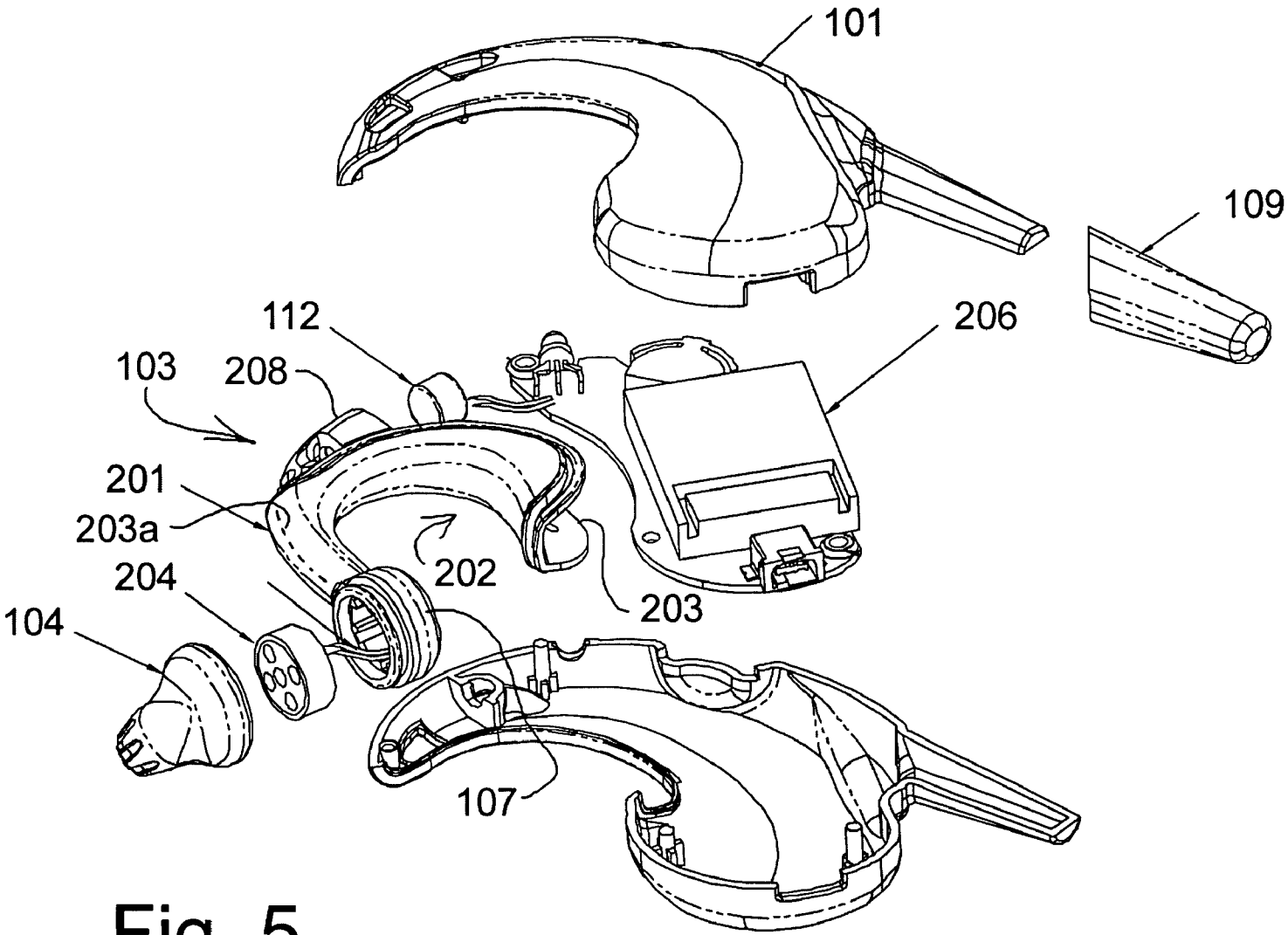
FIG. 5 is an exploded view of the device of FIG. 1.
Figure 10:
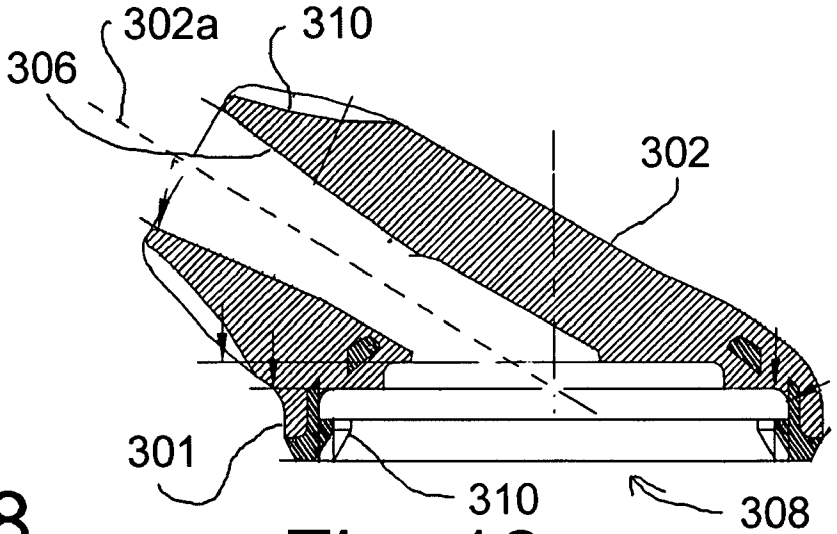
FIG. 10 is a cross section view of the rotatable cap 104 of the device of FIG. 1
Figure 6:
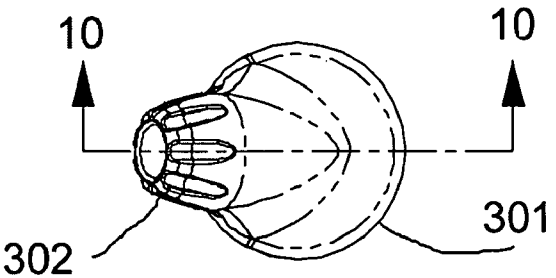
FIG. 6 is a view of the rotatable cap 104 of the device of FIG. 1
Figure 8:
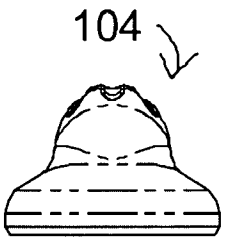
FIG. 8 is an end view of the rotatable cap 104 of the device of FIG. 1
Figure 7:
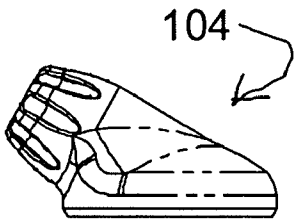
FIG. 7 is a side view of the rotatable cap 104 of the device of FIG. 1
Figure 9:
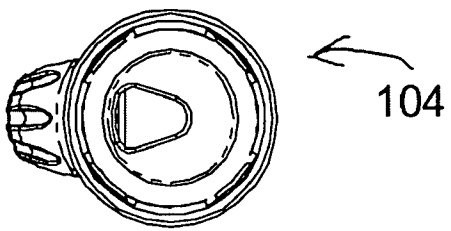
FIG. 9 is a bottom view of the rotatable cap 104 of the device of FIG. 1

As shown in FIG. 5, neck member 103 comprises a neck tube 201 and a curved section 202. The curved section 202 includes a U-shaped portion 203 coupled to earset housing 101. The neck tube 201 and curved section 202 form substantially a U-shape or horseshoe shape to be hooked on the ear. Material of neck member 103 is elastic material such as rubber, urethane rubber or silicone rubber or the like. The neck tube 201 may contain a stiffening member 203*a*, such as a length of copper wire, to allow the neck tube 201 to be formed by the user to the user's own anatomy, and to allow the neck member 103 to retain that shape, once it is formed. Further, the neck member can have embedded in it, a stiffening element, not shown, to enable the non-formable portions of the neck member 103 to retain their as-molded shapes, while still providing for the comfort of the elastic material against the user's skin. The neck member 103 includes a speaker housing 107 and a microphone housing 208. A speaker 204 is located in the speaker housing 107, and microphone 112 is located in the microphone housing 208. A wireless radio 206, such as a Bluetooth radio, FM radio, IEEE 802.11 radio or the like, is located in the earset housing 101.

FIGS. 6-10 show views of one embodiment of rotatable cap 104. Rotatable cap 104 comprises body 301, which is generally cylindrical, rotatably coupled to speaker housing 107 to cover and acoustically seal a speaker 204, and bud 302 which is generally conical extending from the body 301. The central axis 302*a* of bud 302 is located at an oblique angle to the central axis of generally cylindrical body 301. Preferably, the angle between the axis 302*a* of bud 302 and the axis of body 301 is between 15 degrees and 90 degrees. A generally cylindrical port 306 is formed through the bud 302, and the port 306 communicates with a cylindrical port 308 formed through the body 301, and a flange 310 is formed around the periphery of the cylindrical port 308. By rotating rotatable cap 104, the distance between the bottom of the curved section 202 of neck member 103 and the opening end of bud 302 is adjusted to fit the distance between the top of the root of the ear and the entrance of the ear canal of each individual. Material of rotatable cap 104 is elastic material. Preferably, material of rotatable cap 104 is rubber, urethane rubber or silicone rubber or the like.

The bud is preferably made non-occluding by a plurality of notches 310 on its surface, as shown, or by other means such as external longitudinal ridges, lateral piercings, an oval outer cross-sectional shape or the like.

Figure 11:
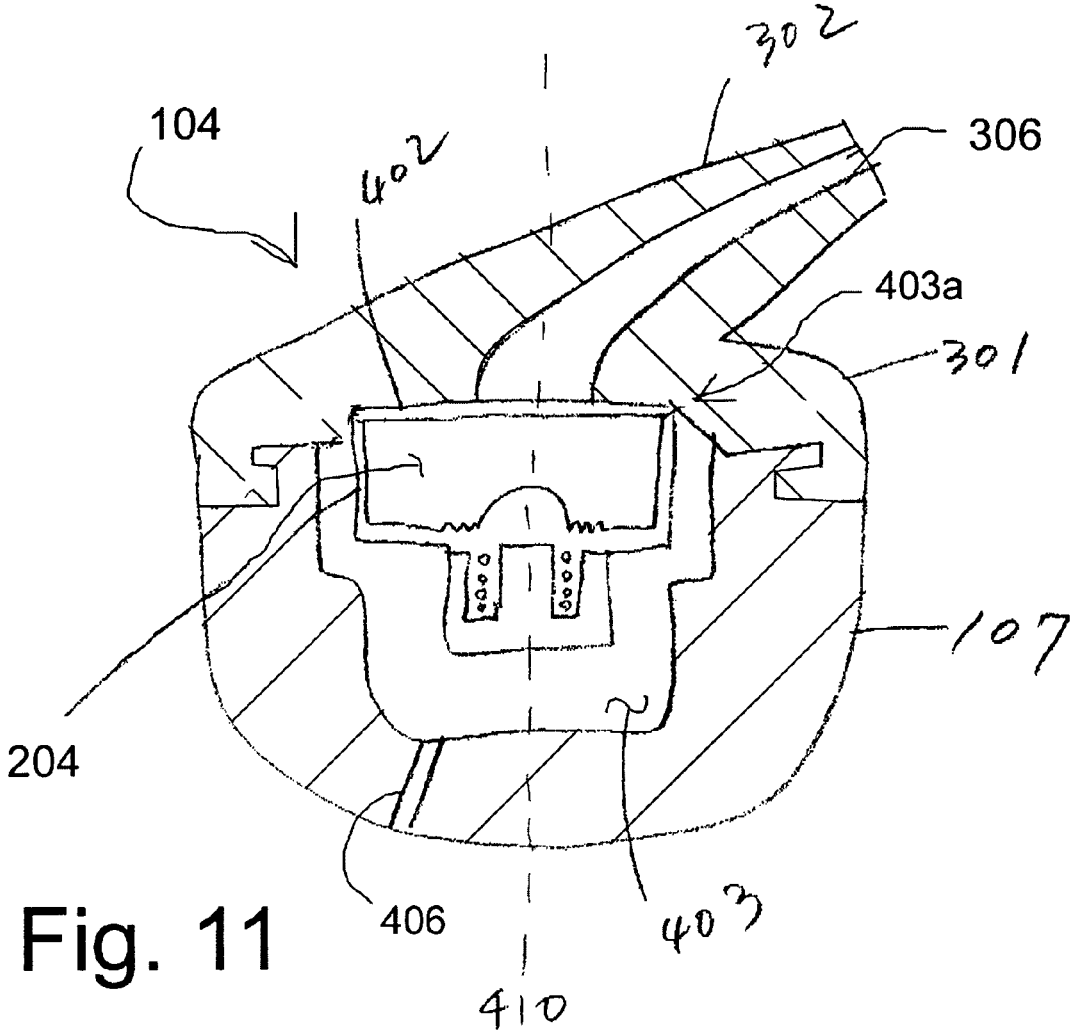
FIG. 11 is a cross section view of the rotatable cap 104 connected to the speaker housing 107.

FIG. 11 shows a cross-sectional view of rotatable cap 104 and speaker housing 107. Speaker driver 204 is contained in speaker housing 107. The front face 402 of speaker driver 204 touches a part of the bottom of body 301 of rotatable cap 104. This allows the elastic material of rotatable cap 103 to form a circular, rotatable seal 403*a* to the front face 402 of the speaker driver 204, preventing the cancellation of sound that would occur if the sound wave from the front of the speaker driver 204 were allowed to mingle with the wave from the back of speaker driver 204. This cancellation would occur because the wave from the front of the speaker driver 204 is exactly 180 degrees out of phase with the wave from the back of speaker driver 204.

There is a contained space between the back of the speaker 204 and the speaker housing 107, and this space is called "back volume" 403. According to well known methods in the art, the back volume and speaker vent 406 form an acoustic Helmholz resonator that is tuned to work with the electro-acoustic parameters of speaker driver 204 to allow the assembly to create high fidelity sound to the ear of the user.

The front sound wave pressure created by the drive of speaker driver 204 is captured by body 301 of rotatable cap 104 and delivered through port 306 toward a user's ear canal. Here it should be understood that the sound tube for delivering sounds created by speaker, consisting of the port 306 formed through the bud 302, is short and speaker driver 204 is located in the speaker housing 107. Since the length of the sound tube is relatively short the earset assembly achieves high efficiency and high fidelity despite a relatively small speaker driver. Also, due to high efficiency and high fidelity, the power consumption of the earset sound assembly decreases. Accordingly, a user can continue to use the earset sound assembly for a longer period without replacing a battery with a new one or recharging a battery. On the other hand, the speaker is relatively large compared to the restricted size of an ear canal located speaker, such as are used in In-The-Canal (ITC) and Completely-In-The-Canal (CIC) hearing aids, allowing for improved bass response fidelity and efficiency as compared to those designs.

Figure 12:
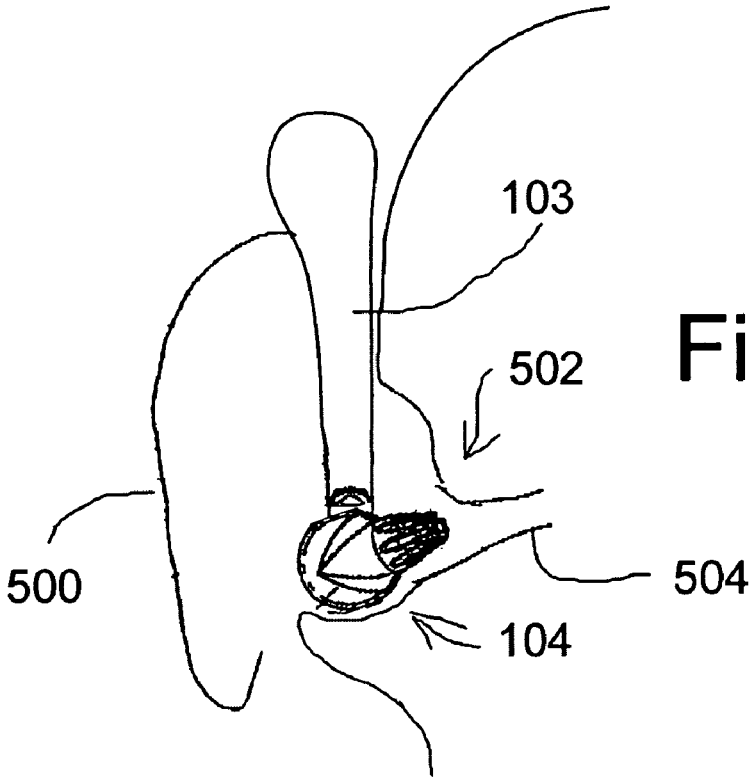
FIG. 12 is a front view of the earset assembly of FIG. 1 placed on a right ear.
Figure 13:
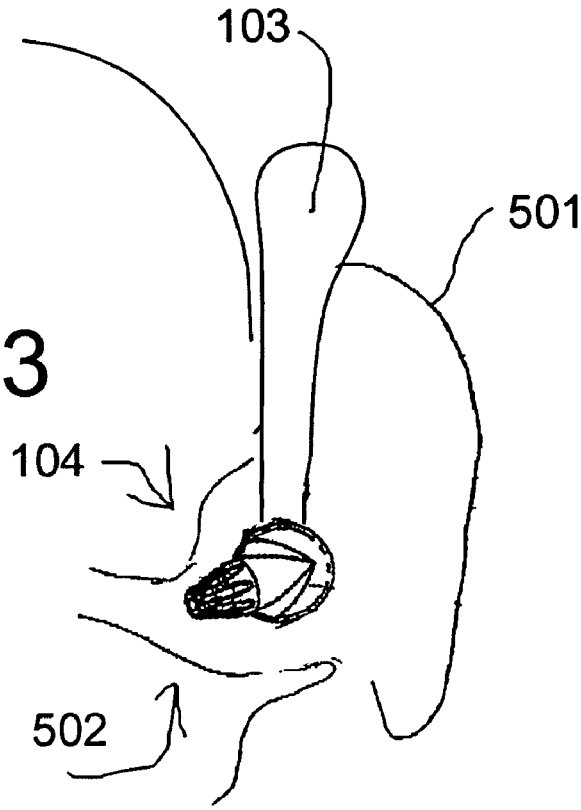
FIG. 13 is a front view of the earset assembly of FIG. 1 placed on a left ear.

FIGS. 12 and 13 are a front view of the earset assembly of FIG. 1 placed on a right ear 500 and a left ear 501, respectively. It should be noted that the axis of the speaker is oriented substantially perpendicular to the axis of the ear canal 504 of the user with the front face 402 of the speaker directed forward, in the direction the user is facing.

Figure 14:
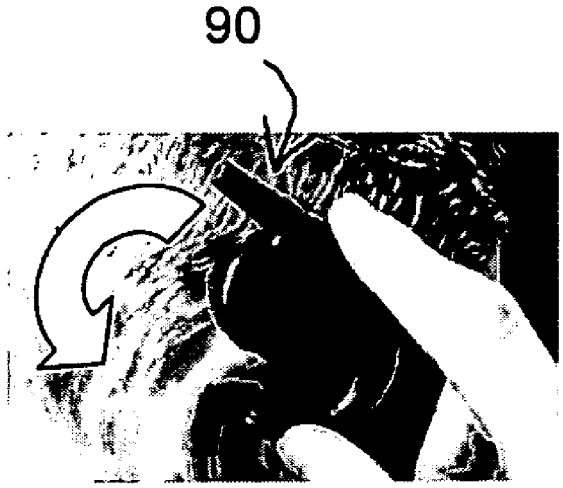
FIG. 14 illustrates how a user mounts the assembly to the user's ear.
Figure 15:
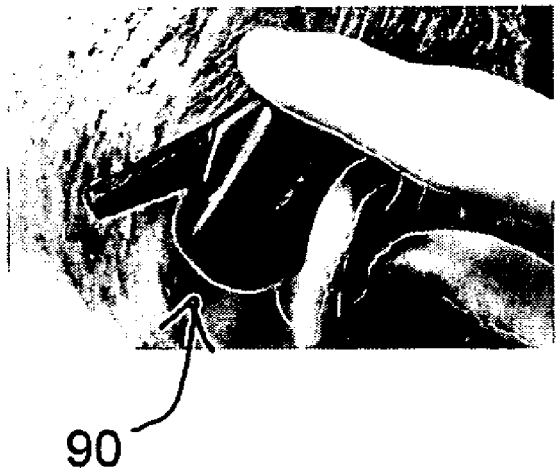
FIG. 15 illustrates how a user mounts the assembly to the user's ear.

A user can wear the earset assembly of the present embodiment according to the following steps, illustrated in FIGS. 14 and 15. First, a user rotates the rotatable cap 104 so as to direct bud 302 toward the ear on which the user wants to wear the assembly. The user puts bud 302 at entrance 502 of ear 500 (or 501), and then places earset housing 101 above ear 500 (or 501) as seen in FIG. 14. Then, the user rotates earset housing 101 rearward behind the auricle so as to securely hook the assembly on the ear, as shown in FIG. 15. If the bud 302 is not directed toward the user's ear entrance 502, the user can remove the device and adjust the angle of rotatable cap 104 to make the assembly secure, yet comfortable. This adjustment only needs to be made once for a new user. It should be noted that the ports 110 are located symmetrically on each side of the device to allow for use of the device on either ear.

Further, neck tube 201 is adjustable as described above by forming the neck tube 201 into any comfortable shape, for example by forming the neck tube 201 in a lateral curve to increase or decrease the distance of the end of bud 104 from the entrance of the ear 502. Such adjustment is retained by the stiffening member 203*a*, even when the device is off the ear.

The structure of the earset assembly of the present invention allows a user to wear the earset assembly on either of right and left ear, placing the ear bud very close to the entrance of the ear 502 and securely hooking the earset assembly on the ear according to the above described procedure. Because neck member 103 is primarily elastic material such as rubber, urethane rubber or silicone rubber, which is flexible and adjustable to fit the individual user, a user does not feel uncomfortable tension and a user does not feel irritated in wearing the earset assembly. Consequently, the user can use the earset assembly with great comfort for an extended period.

Moreover, it should be understood that the rotatable cap 104 can be rotated to any angle to fit a wide variety of users. This is best understood with reference to FIGS. 12 and 13. As shown in FIG. 12 the distance between the top of the user's ear and the entrance 502 to ear canal is relatively short, so the rotatable cap is located with the axis of port 306 oriented at an angle upward from the horizontal. On the other hand, as shown in FIG. 13 the distance between the top of the user's ear and the entrance 502 to ear canal is relatively long, so the rotatable cap is located with the axis of port 306 oriented at an angle downward from the horizontal.

FIGS. 16 and 17 show a top view and a side view of another example of rotatable cap 104, respectively. Bud 701 extending from the surface of body 702 has a cylindrical shape. The diameter of bud 701 is selected to fit opening end 703 of bud 701 to an entrance of the ear canal.

FIGS. 18 and 19 show a top view and a side view of another example of rotatable cap 104, respectively. Bud 801 is extended from the side surface of body 802, and directs in a direction parallel to front face 402 of speaker driver 401.

Figure 20:
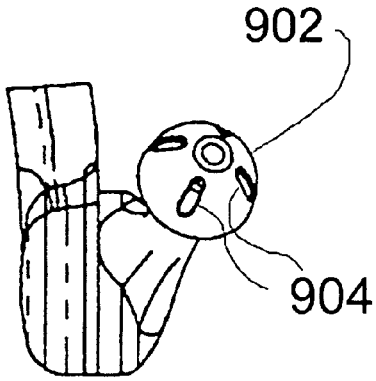
FIG. 20 is a front view of another example of rotatable cap 104 of FIG. 1.
Figure 21:
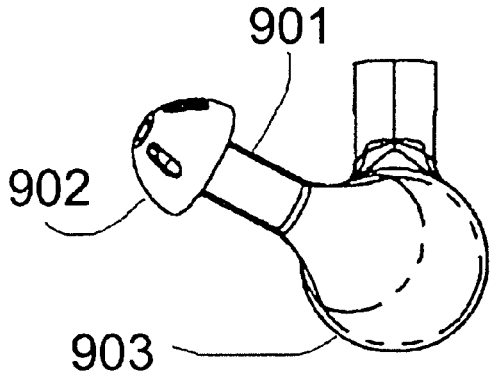
FIG. 21 is a side view of another example of rotatable cap 104 of FIG. 1.

FIGS. 20 and 21 show a top view and a side view of another example of rotatable cap 104, respectively. A bud comprises cylinder 901 extended from body 903 and mushroom shaped part 902 coupled with the ear end of cylinder 901. The bud directs in an oblique direction to the plane parallel to the bottom of body 903 so as to just enter the opening of the ear canal. Preferably, the angle between the axis of the bud and the axis of generally cylindrical body 903 is between 15 degrees and 90 degrees. The mushroom shaped part is of relatively thin and resilient material and includes a plurality of port piercings 904. The port piercings 904 prevent occlusion by preventing a complete seal of the mushroom shaped part 902 with the inside of the ear canal. When the mushroom shaped part is inserted into the ear canal it deforms slightly and tends to be captured and not easily fall out or be jarred loose. Therefore this design is useful for sport models of the device.

Figure 21A:
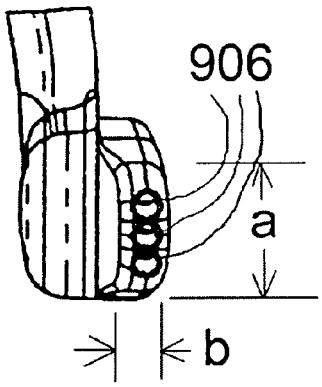
FIG. 21*a* is a front view of another example of rotatable cap 104 of FIG. 1.
Figure 21B:
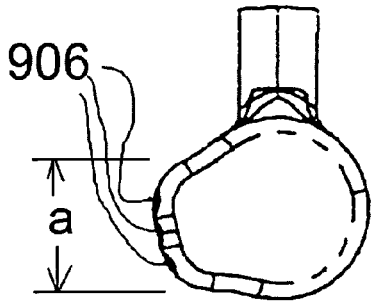
FIG. 21*b* is a side view of another example of rotatable cap 104 of FIG. 1.

FIGS. 21*a* and 21*b* show a top view and a side view of another example of rotatable cap 104, respectively. In this embodiment the bud includes three sound ports 906. When viewed in FIG. 21*a* the vertical dimension "a" of the end of the bud can be seen to be longer than its horizontal dimension "b". Accordingly when the bud is inserted in the ear canal the long axis contacts the ear canal while the short axis does not, so that the bud is prevented from being occluding.

Figure 22:
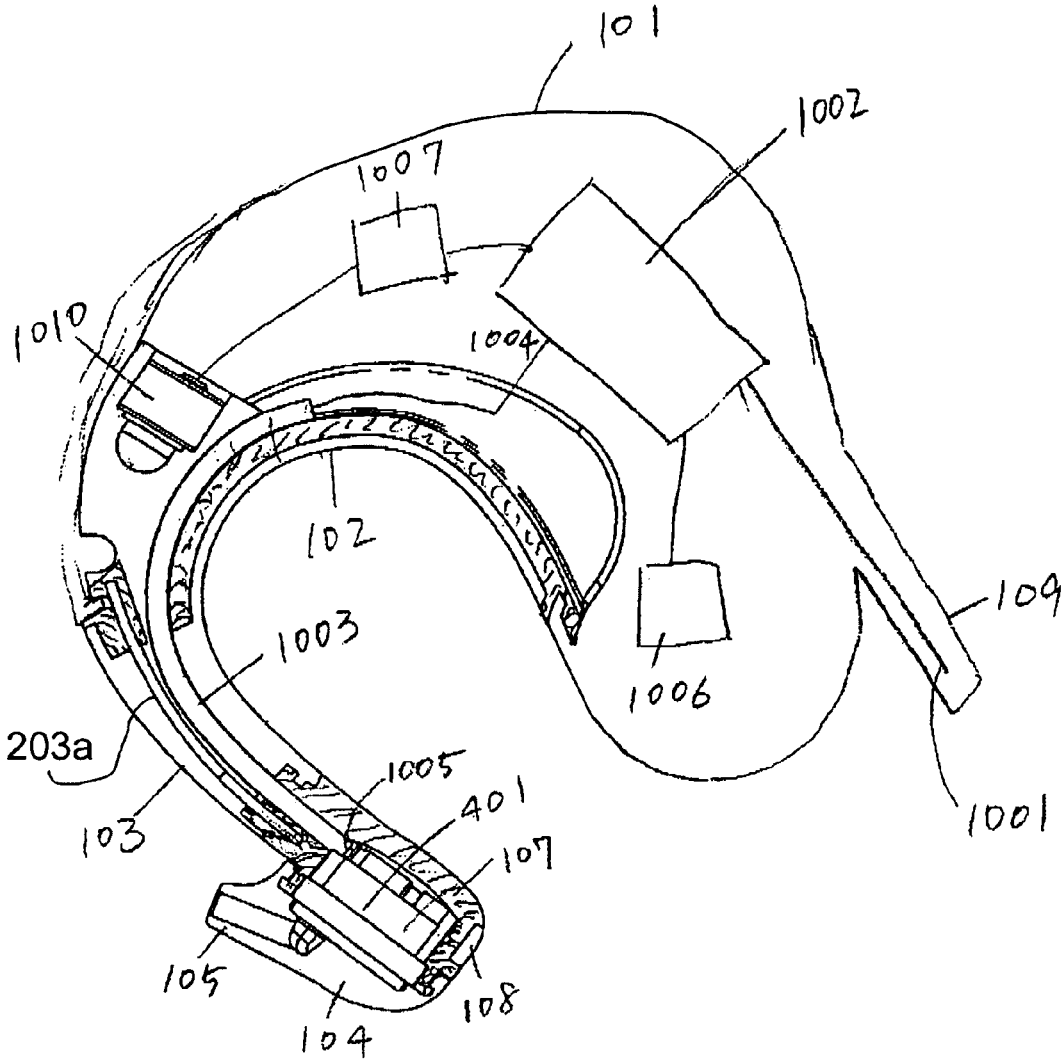
FIG. 22 is a cross-sectional view of an earset assembly according to one embodiment of the present invention.

FIG. 22 shows a cross-sectional view of an earset assembly in one embodiment of the present invention. As shown in FIG. 22, the earset assembly comprises antenna 1001, circuitry 1002 for processing a signal received by antenna 1001, and wire 1003 contained in neck member 103 which connects between output port 1004 of circuitry 1002 and input port 1005 of speaker driver 401, and battery 1006. Circuitry 1002 and battery 1006 are contained in earset housing 101. Battery 1006 supplies the electrical power to speaker driver 401 and circuitry 1002. Battery 1006 may be rechargeable so that the assembly may comprise a port for recharging battery 1006. Alternatively, an external power source may supply the electrical power to speaker driver 401 and circuitry 1002 through a cable so that battery 1006 need not be contained in earset housing 101. Antenna 1001 is contained in antenna enclosure portion 109. Alternatively, antenna 1001 may be covered by another cover or uncovered. A signal received by antenna 1001 is processed by circuitry 1002, and then transmitted to speaker driver 401 through wire 1003 in neck member 103.

Speaker driver 401 transduces the transmitted electrical signal to a sound, and then the sound is delivered to an ear of the user through a hollow in bud 105.

An earset assembly further comprises microphone 1010 as shown in FIG. 22. Preferably, microphone 1010 is placed near the end of curved portion in earset housing 101, that is the bottom of U-shape configured by the coupling of earset housing 101 and neck member 103. Earset housing 101 has one or more holes called microphone sound ports near microphone 1010. A sound received by microphone 1010 via the microphone sound ports is transduced to an electrical signal. The electrical signal is processed by a circuitry 1007 contained in earset housing 101, and communicated with an external communication device or multimedia device through antenna 1001.

Figure 23:
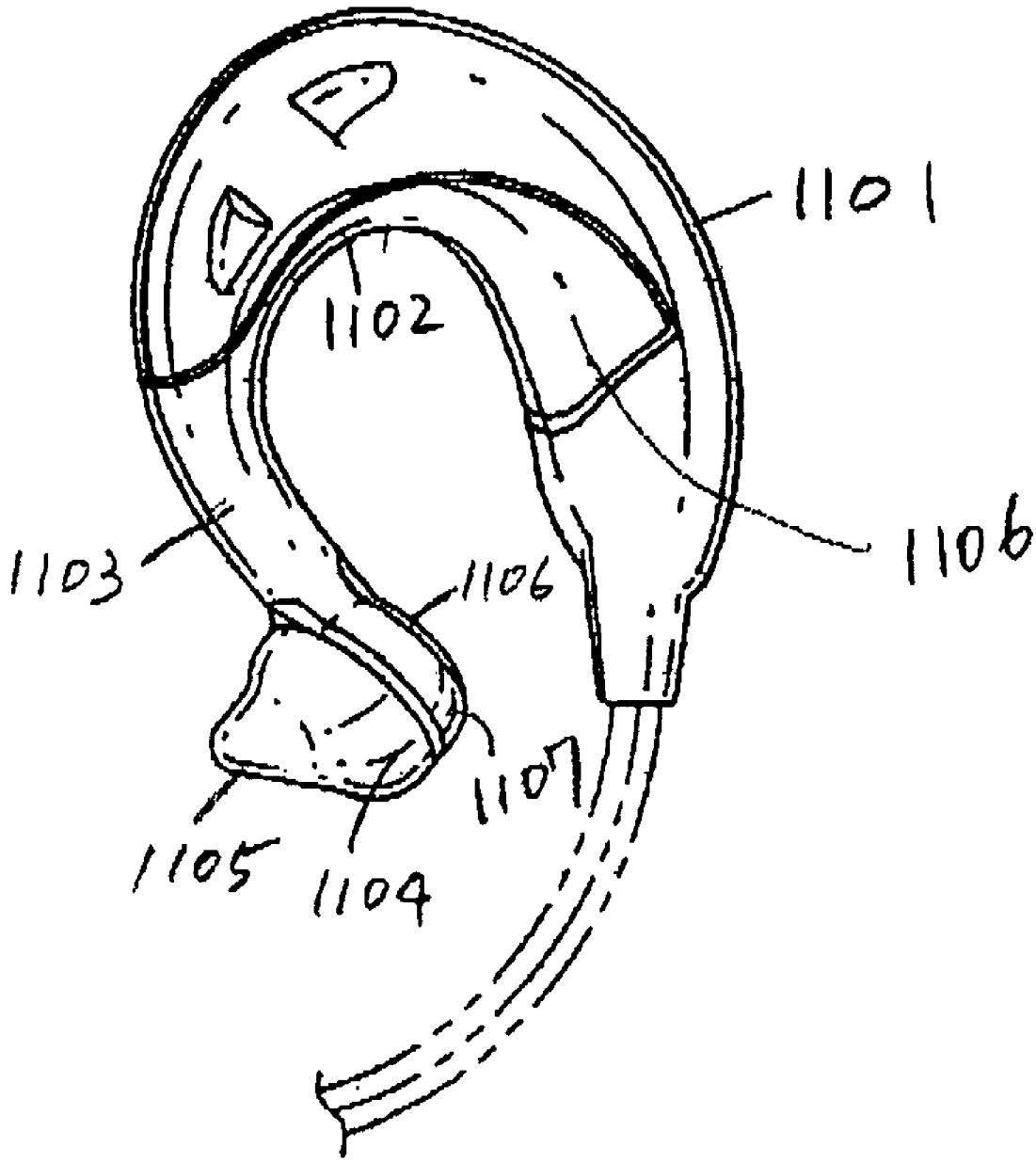
FIG. 23 is a perspective view of a wired type earset assembly in another embodiment of the present invention.
Figure 24:
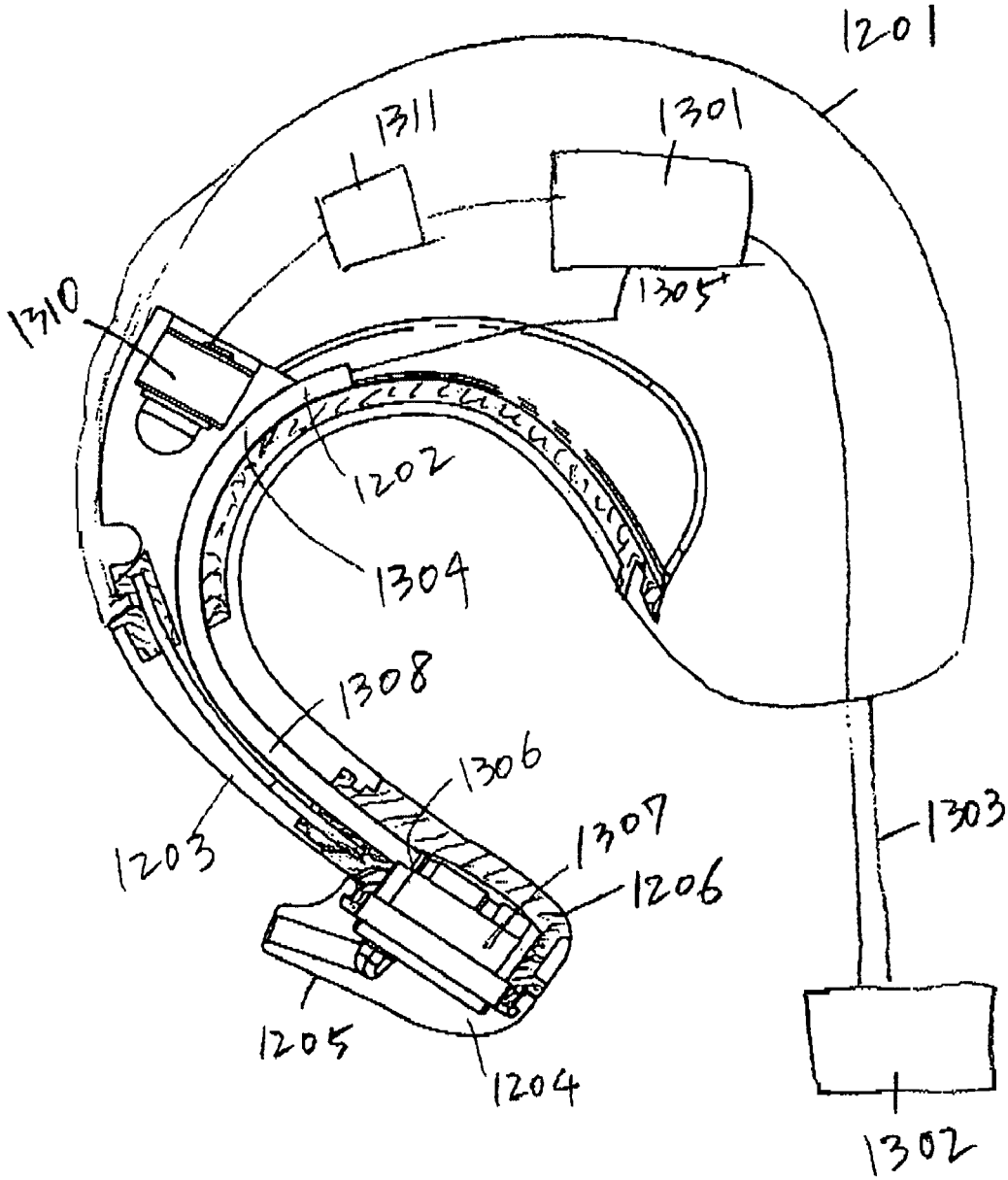
FIG. 24 is a cross-sectional view of the earset assembly of FIG. 23.

In accordance with another embodiment of the present invention, FIG. 23 shows a perspective view of a wired type earset assembly. As shown in FIG. 23, the earset assembly comprises housing 1101 having curved portion 1102 configured to fit to the top of an ear, flexible tube 1103, rotatable cap 1104 having bud 1105, and speaker housing 1107 coupled with rotatable cap 1104. The flexible tube 1103 and curved portion 1102 are substantially U-shaped to be hooked on the ear. FIG. 24 shows a cross-sectional view of the earset assembly of FIG. 23. As shown in FIG. 24, the earset assembly further comprises circuitry 1301 coupling with external signal source 1302 such as communication device and multimedia device through a cable 1303, wire 1304 contained in flexible tube 1203 which connects between output port 1305 of circuitry 1301 and input port 1306 of speaker driver 1307. Circuitry 1301 processes a signal transmitted through cable 1303 and then processed signal is further transmitted to speaker driver 1307 through wire 1308 in flexible tube 1203. Electrical power is supplied to circuitry 1301 through cable 1303 and also supplied to speaker driver 1307. Speaker driver 1307 transduces the transmitted electrical signal to a sound, and then the sound is delivered to an ear of the user through a hollow in bud 1205.

An earset assembly further comprises microphone 1310 as shown in FIG. 24. Preferably, microphone 1310 is placed near the end of curved portion in housing 1201, that is the bottom of the U-shape configured by the coupling of housing 1201 and flexible tube 1203. Housing 1201 has one or more holes called microphone sound ports near microphone 1310. A sound received by microphone 1310 via the microphone port (s) is transduced to an electrical signal. The electrical signal is processed by a circuitry 1311 contained in housing 1201, and communicated with external communication device or multimedia device 1302.

It should be understood that the design of neck member 103 is an important feature. As designed, all the critical electro-acoustic and ergonomic (human fit) elements of the device are captured in this one neck member sub-assembly. Accordingly, the neck member sub-assembly controls the delivered sound frequency response, loudness, loudness/distortion trade-off, mic pickup directionality, mic sensitivity, mic SNR, top-of-ear comfort, ear variation adjustability (one size fits all), ear occlusion, microphone wind noise rejection, and even the product's as-worn appearance (Hair, the ear and head coverings usually "camouflage" the back of the instrument, i.e. the earset housing 101 when worn so the neck member sub-assembly becomes the most visible element of the earset).

Thus, the neck member 103 sub-assembly is designed so that it can be pre-built and pre-tested, thereby controlling the quality of the product. The remainder of the device, which is housed in earset housing 101, consists of highly reliable and consistent parts (i.e. the radio, battery and housings), so later assembly of these parts to the neck member 103 sub-assembly is routine. Yet, all product differentiation can readily be done in the earset housing 101. For example, the Bluetooth radio can be changed to 802.11 radio (for VoIP applications), or to low-power FM radio for low cost applications, without affecting the customer's product perception (It looks and works the same to them). As another example, the battery can be changed from LiIon to NiCd to LiP to NiMH without any change to the perceived product or its audio performance. Yet another example, housing colors, logo printing, shape and size, can all be changed while the acoustics and ergonomics do not change. Thus, how the product feels and acts remains captured in the neck member 103 sub-assembly. Despite this product flexibility, it is unnecessary to redesign and qualify another electro-acoustic solution every time it is desired to make a product change.

Furthermore, the special neck member 103 simplifies the testability of the device. The neck member 103 sub-assembly can be tested for acoustic performance by installing the speaker and microphone in the neck member 103 and then connecting the tester signal leads to the speaker and microphone leads. After testing is completed satisfactorily, the neck member 103 is affixed to the earset housing 101 with its included components.

Another important point to note about the neck member 103 is that it is single part that houses both a speaker and a microphone without feedback between them. Usually, such an assembly is undesirable, since audio frequency mechanical vibrations created by the speaker travel directly to the microphone creating feedback "echo", in other words the listener at the other end of the communication hears his own voice returning to him/her with a two-way delay. This can be very disturbing and prevent easy communication. However, the neck member 103 overcomes this since the use of elastomeric material allows this single sub-assembly to avoid the feedback problem.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. An earpiece for sound delivery comprising:

(a) a housing;

(b) a speaker having a speaker axis and located in said housing; and, (c) a rotatable cap having a sound exit port configured to directly communicate sound from the speaker to an ear canal of a user when the earpiece is worn by the user, the sound being adjustably directable from the speaker away from the direction of the speaker axis towards the ear canal of the user such that adjustment of a primary direction of sound propagation from the earpiece is achieved without disassembly of the rotatable cap from the housing.

2. An earpiece according to claim 1 wherein said rotatable cap comprises a body rotatably coupled to said housing, a bud extending from the body, and port means for providing sound communication from the speaker to the end of the bud.

3. An earpiece according to claim 2 wherein said bud is constructed so as not to occlude the ear when inserted in the entrance to a user's ear.

4. An earpiece according to claim 2 wherein said bud includes grooves so that said bud does not occlude the ear when inserted in the entrance to a user's ear.

5. An earpiece according to claim 2 wherein said bud has a diameter less than the diameter of the entrance to the user's ear so that said bud does not occlude the ear when inserted in the entrance to a user's ear.

6. An earpiece for sound delivery according to claim 2, wherein the bud has a substantially frusto conical shape.

7. An earpiece according to claim 2 wherein said port means comprises one port.

8. An earpiece for sound delivery according to claim 2, wherein the bud is a cylinder.

9. An earpiece for sound delivery according to claim 2, further comprising a hollow mushroom-shaped element coupled with an end of the bud.

10. An earpiece for sound delivery according to claim 1, wherein the user's head has a front, a back and two sides, and the speaker is oriented with an angle between 45 degrees and 135 degrees to a side of the head of the user, an output side of the speaker facing to the front of the head of the user.

11. An earpiece for sound delivery according to claim 1, wherein the axis of the speaker is oriented substantially perpendicularly to the axis of the ear canal of a user.

12. An earpiece for sound delivery according to claim 1, wherein an angle of the axis of the bud to the axis of the speaker is between 15 degrees and 90 degrees.

13. An earpiece for sound delivery according to claim 2, wherein the material of the cap is silicone rubber.

14. An earpiece according to claim 1, wherein, when the earpiece is worn by a user, the axis of the speaker is substantially perpendicular to the axis of the user's ear canal.

15. An earpiece according to claim 2, wherein substantially perpendicular to the axis of the user's ear canal includes a range of angles of said speaker axis of between plus 45 degrees and minus 45 degrees to a line perpendicular to the axis of the user's ear canal.

16. An earpiece according to claim 1, wherein the rotatable cap is configured such that the angle between the speaker axis and the direction of sound propagation from the earpiece is between 15 degrees and 90 degrees, and, when the earpiece is worn by a user, the axis of rotation of the rotatable cap is substantially perpendicular to the axis of the user's ear canal.

17. An earpiece according to claim 1, wherein the housing in which the speaker is positioned is a speaker housing, and said speaker housing is supported by an earset housing configured to fit the top of a user's ear, such that the speaker housing is supported adjacent to the ear canal of the user's ear.

18. An earpiece according to claim 1, wherein, when the earpiece is worn by a user, a front face of the speaker is directed substantially forward, in the direction the user is facing.

19. An earset sound delivery device comprising:

(a) support means to support a speaker having a speaker axis in the concha of a user's ear; and (b) a rotatable cap rotatably coupled to said support means, the rotatable cap having a sound exit port configured to directly communicate sound from the speaker to an ear canal of a user when the earpiece is worn by the user, said rotatable cap being rotatable without uncoupling said rotatable coupled cap to various angles to accommodate anatomical differences among users, said rotatable cap configured to adjustably direct sound from the speaker away from the direction of the speaker axis towards the ear canal of a user such that adjustment of a primary direction of sound propagation from the earset sound delivery device is achieved.

20. An earset sound delivery device according to claim 19 wherein said rotatable cap is rotatable about the axis of the speaker.

21. An earset sound delivery device according to claim 19 wherein said cap is constructed to form an acoustic seal with said speaker.

* * * * *

UNITED STATES PATENT AND TRADEMARK OFFICE

CERTIFICATE OF CORRECTION

PATENT NO. : 7,570,777 B1
APPLICATION NO. : 10/757796
DATED : August 4, 2009
INVENTOR(S) : Jon C. Taenzer and Thanh Q. Nguyen It is certified that error appears in the above-identified patent and that said Letters Patent is hereby corrected as shown below:

Title page, item (75), remove inventor Donald R. Saleh

Signed and Sealed this

Fifteenth Day of September, 2009

David J. Kappos

David J. Kappos
*Director of the United States Patent and Trademark Office*